US011203929B2

(12) United States Patent
Berning et al.

(10) Patent No.: US 11,203,929 B2
(45) **Date of Patent: *Dec. 21, 2021**

(54) MILLING MACHINE AND PROCESS FOR THE OPERATION OF A MILLING MACHINE

(71) Applicant: Wirtgen GmbH, Windhagen (DE)

(72) Inventors: Christian Berning, Zülpich (DE); Andreas Vogt, Asbach (DE); Thomas Lehnert, Oberraden (DE); Cyrus Barimani, Königswinter (DE)

(73) Assignee: Wirtgen GmbH

( * ) Notice: Subject to any disclaimer, the term of this patent is extended or adjusted under 35 U.S.C. 154(b) by 103 days.

This patent is subject to a terminal disclaimer.

(21) Appl. No.: 16/535,407

(22) Filed: Aug. 8, 2019

(65) Prior Publication Data

US 2020/0072049 A1 Mar. 5, 2020

Related U.S. Application Data

(63) Continuation of application No. 15/679,199, filed on Aug. 17, 2017, now Pat. No. 10,378,350.

(30) Foreign Application Priority Data

Aug. 30, 2016 (DE) ..... 10 2016 010 390.6

(51) Int. Cl.
*E01C 23/088* (2006.01)
*E21C 25/10* (2006.01)
(Continued)

(52) U.S. Cl.
CPC ..... *E21C 25/10* (2013.01); *E01C 23/088* (2013.01); *E01C 23/127* (2013.01); *E21C 29/22* (2013.01); *E21C 35/00* (2013.01)

(58) Field of Classification Search
CPC ..... E21C 25/10; E01C 23/088; E01C 23/127
See application file for complete search history.

(56) References Cited

U.S. PATENT DOCUMENTS 2,311,891 A 2/1943 Tyson
3,606,742 A 9/1971 Wieneke et al.
(Continued)

FOREIGN PATENT DOCUMENTS

DE 10203732 A1 8/2003
DE 10213017 A1 10/2003
(Continued)

OTHER PUBLICATIONS

EPO office action in corresponding EPO Patent Application No. 17 18 6317 dated Jul. 18, 2019, 6 pp. (not prior art).
(Continued)

*Primary Examiner* — Sunil Singh
(74) *Attorney, Agent, or Firm* — Lucian Wayne Beavers; Gary L. Montle; Patterson Intellectual Property Law, PC

(57) ABSTRACT

The invention relates to a milling machine, in particular a road milling machine, a stabiliser, a recycler or a surface miner, comprising a drive means which is configured such that the milling machine performs translatory and/or rotatory movements on the ground, and a working means which is configured such that the ground is machined. The invention also relates to a method for operating a milling machine of this type. The milling machine according to the invention has a control unit 15 to input drive parameters and work parameters. The control unit 15 is distinguished by a selection unit 15C to select an operating mode from a plurality of operating modes. The control and processing unit 20 has a memory 20A which stores at least one predetermined drive parameter which is assigned to the operating mode, and/or at least one predetermined work parameter which is assigned to the operating mode, for each operating mode of the
(Continued)

plurality of operating modes. The control and processing unit 20 is configured such that at least one assembly 4, 5; 8, 10, 11, 12, 13, 17, 18, 19 of the drive means and working means is controlled subject to the at least one drive parameter or work parameter which is stored in the memory 20A for the operating mode selected using the selection unit 15C, such that the particular machine function is carried out. The milling machine further provides that at least one function which describes the dependence of a work parameter of one assembly on a drive parameter of another assembly is stored for each operating mode, the control and processing unit 20 being configured such that, based on this function, at least one assembly of the working means or drive means is controlled such that the particular machine function is carried out.

20 Claims, 3 Drawing Sheets

(51) Int. Cl.

| | |
|---|---|
| ***E01C 23/12*** | (2006.01) |
| ***E21C 29/22*** | (2006.01) |
| ***E21C 35/00*** | (2006.01) |

(56) References Cited

U.S. PATENT DOCUMENTS

| | | | |
|---|---|---|---|
| 3,750,762 | A | 8/1973 | Eaton |
| 4,043,402 | A | 8/1977 | Nelson |
| 4,277,898 | A | 7/1981 | Flippin |
| 4,333,685 | A | 6/1982 | Arnswald |
| 4,343,513 | A | 8/1982 | Godbersen |
| 4,549,610 | A | 10/1985 | Van der Lely |
| 4,588,231 | A | 5/1986 | Silay et al. |
| 4,614,305 | A | 9/1986 | Fekete et al. |
| 4,655,634 | A | 4/1987 | Loy et al. |
| 4,903,780 | A | 2/1990 | Barbieri |
| 4,929,121 | A | 5/1990 | Lent et al. |
| 5,190,398 | A | 3/1993 | Swisher |
| 5,318,378 | A | 6/1994 | Lent |
| 5,415,495 | A | 5/1995 | Johnson |
| 5,879,056 | A | 3/1999 | Breidenbach |
| 6,170,341 | B1 | 1/2001 | Avitan |
| 6,186,248 | B1 | 2/2001 | Silay et al. |
| 6,338,281 | B1 | 1/2002 | El-Ibiary et al. |
| 6,407,475 | B1 | 6/2002 | Care |
| 6,558,072 | B2 | 5/2003 | Staffenhagen et al. |
| 6,921,230 | B2 | 7/2005 | Silay |
| 7,422,391 | B2 | 9/2008 | Holl et al. |
| 7,530,641 | B2 | 5/2009 | Berning et al. |
| 7,905,682 | B2 | 3/2011 | Holl et al. |
| 7,984,953 | B2 | 7/2011 | Gaertner et al. |
| 8,128,177 | B2 | 3/2012 | Menzenbach et al. |
| 8,292,371 | B2 | 10/2012 | Menzenbach et al. |
| 8,465,105 | B2 | 6/2013 | Parker et al. |
| 8,632,132 | B2 | 1/2014 | Wenzenbach et al. |
| 8,668,274 | B2 | 3/2014 | Gaertner et al. |
| 10,358,780 | B2 | 7/2019 | Berning et al. |
| 10,370,803 | B2 | 8/2019 | Berning et al. |
| 10,378,350 | B2 * | 8/2019 | Berning et al. |
| 2007/0286678 | A1 | 12/2007 | Berning et al. |
| 2008/0173740 | A1 | 7/2008 | Parker et al. |
| 2010/0014917 | A1 | 1/2010 | Willis et al. |
| 2011/0080034 | A1 | 4/2011 | Schnebeck et al. |
| 2014/0191560 | A1 | 7/2014 | Gaertner et al. |
| 2015/0086268 | A1 | 3/2015 | Johnson et al. |
| 2015/0227120 | A1 | 8/2015 | Laux et al. |
| 2015/0252539 | A1 | 9/2015 | Berning et al. |
| 2016/0356004 | A1 | 12/2016 | Berning et al. |
| 2017/0233959 | A1 | 8/2017 | Berning et al. |
| 2017/0254032 | A1 | 9/2017 | Husar |

FOREIGN PATENT DOCUMENTS

| | | | |
|---|---|---|---|
| DE | 102006024123 | A1 | 11/2007 |
| DE | 112008000646 | T5 | 5/2010 |
| DE | 102014001885 | A1 | 8/2015 |
| DE | 102015002426 | A1 | 6/2016 |
| EP | 2354310 | A2 | 8/2011 |
| EP | 2722441 | A1 | 4/2014 |
| EP | 2840183 | A1 | 2/2015 |
| EP | 3208382 | A1 | 8/2017 |
| WO | 03064770 | A1 | 8/2003 |
| WO | 2016102410 | A1 | 6/2016 |

OTHER PUBLICATIONS

European Search Report for corresponding EPO Patent Application No. 17 18 6317 dated Jan. 3, 2018, 9 pp. (not prior art).

* cited by examiner

MILLING MACHINE AND PROCESS FOR THE OPERATION OF A MILLING MACHINE

BACKGROUND OF THE INVENTION

The invention relates to a milling machine, in particular to a road milling machine, a stabiliser, a recycler or a surface miner, having a drive means which is configured such that the milling machine performs translatory and/or rotatory movements on the ground, and a working means which is configured such that the ground is machined. The invention also relates to a method for operating a milling machine of this type.

Different embodiments of ground milling machines are known, which include in particular road milling machines, stabilisers, recyclers or surface miners. The known milling machines are distinguished by a drive means for carrying out translatory and/or rotatory movements of the machine on the ground and by a working means for machining the ground. The drive means has at least one assembly which performs a specific machine function subject to drive parameters, and the working means has at least one assembly which performs a specific machine function subject to work parameters. In turn, the individual assemblies of the drive means and of the working means can comprise a plurality of components.

In the following, "a drive means" is understood as meaning all the components of the road milling machine which are intended or are suitable for moving the machine, and "a working means" is understood as meaning all the components of the road milling machine which are intended for or are suitable to be used during the machining of the ground. The drive means and the working means can also have common components. A common component of the drive means and of the working means can be a driving engine, in particular an internal combustion engine.

The driving power of the internal combustion engine can be transmitted to hydraulic pumps by a pump distributor gearbox to supply hydraulic motors, provided in the running gear units of the milling machine, with hydraulic fluid. The drive means then comprises the internal combustion engine, the pump distributor gearbox, the hydraulic pumps and the running gear units with the hydraulic motors. The travel speed of the milling machine can be controlled continuously by a corresponding adjustment of the hydraulic pumps at different speeds of the internal combustion engine.

A fundamental assembly of the working means is the milling/cutting drum which, in the case of known milling machines, is arranged in a milling drum housing. The milling/cutting drum is generally driven by the single driving engine of the milling machine, the driving power of the driving engine being transmitted to the milling/cutting drum by a mechanical transmission. Thus, the speed of the milling/cutting drum is determined by the speed of the internal combustion engine and by the transmission ratio of the transmission. The milling/cutting drum can also be driven hydraulically, for example, in which case the speed is controlled via a corresponding adjustment of the hydraulic pumps.

However, the working means can also comprise further assemblies which cooperate with the milling/cutting drum to machine the ground. Included here are, for example, a hold-down device which can be adjusted in height relative to the ground and which is arranged upstream of the milling/cutting drum in the working direction of the milling machine, or a stripping device which can be adjusted in height relative to the ground, which rests on the ground with a predetermined contact force and is arranged downstream of the cutting/milling drum in the working direction of the milling machine, or an edge protection device which can be adjusted in height relative to the ground, which rests on the ground with a predetermined contact force and is arranged in the longitudinal direction of the milling machine.

Milling machines have a central control and processing unit which is configured such that the assemblies of the drive means are controlled such that a specific machine function is carried out, and the assemblies of the working means are controlled such that a specific machine function is carried out. A specific machine function is carried out subject to specific operating parameters which are preset by the machine operator. In the following, the operating parameters which are considered during the control of the assemblies of the drive means are denoted as drive parameters and the parameters which are considered during the control of the assemblies of the working means are denoted as work parameters.

In order to input the drive and work parameters, milling machines have a control unit which can be configured in different ways. The control unit can have, for example, pushbuttons or switches, sliders or joysticks, or it can be configured as a touch screen.

The operation of a milling machine is a complex task for the machine operator. The machine operator must preset all the drive and work parameters so that the desired milling result is achieved. In this respect, the machine operator must bear in mind that presetting one operating parameter can directly influence another parameter. During operation of the milling machine, the interaction of all the parameters is critical for the quality of the milled surface. Therefore, the operation of a milling machine requires a very experienced machine operator.

SUMMARY OF THE INVENTION

The object of the invention is to provide a milling machine which is easier for the machine operator to operate. A further object of the invention is to provide a method for operating a milling machine which simplifies the operation of the machine.

These objects are achieved by the features of the independent claims. The dependent claims relate to advantageous embodiments of the invention.

The milling machine according to the invention has a control unit for inputting operating parameters in order to control the drive means and the working means. Via the control unit, the machine operator can input all the parameters which are essential to the project. For example, the machine operator can adjust the motor power of the driving engine, the travel speed of the milling machine, the milling depth or the speed of the milling drum. However, in the milling machine according to the invention, it is not necessary to adjust all the drive parameters and work parameters for the particular milling task.

The control unit is distinguished by a selection unit for selecting an operating mode from a plurality of operating modes. Consequently, the machine operator only needs to select one operating mode for the project. If the task is fine milling for example, in order to achieve a fine milled surface, the machine operator only needs to select the fine milling mode of operation. For fine milling, depending on the particular milling task, a plurality of operating modes can also be provided which can consider the required working time or the wear of the milling tools.

The control and processing unit has a memory which stores, for each operating mode of the plurality of operating modes, at least two predetermined operating parameters which are assigned to the operating mode. Therefore, the relevant operating parameters do not need to be set by the machine operator, but they can be read out of the memory.

The control and processing unit is configured such that at least one assembly is controlled subject to the at least two operating parameters which are stored in the memory for the operating mode selected using the selection unit, such that the particular machine function is carried out. When two assemblies are controlled, each assembly can be controlled on the basis of one operating parameter of the at least two operating parameters. Consequently, the milling machine is controlled by the operating parameters which are assigned to the operating mode selected by the machine operator. Therefore, the parameters do not have to be assigned by the machine operator, so that the operator is relieved of this task. An optimum milling result is thus achieved solely by the selection of the operating mode.

In a preferred embodiment, the operating parameters comprise drive parameters and work parameters, the drive means having at least one assembly which performs a specific machine function subject to drive parameters, and the working means having at least one assembly which performs a specific machine function subject to work parameters, at least two predetermined work parameters which are assigned to the operating mode being stored in the memory for each operating mode of the plurality of operating modes. In this embodiment, the control and processing unit is configured such that at least one assembly of the working means is controlled subject to the at least two work parameters which are stored in the memory for the operating mode selected using the selection unit, such that the particular machine function is carried out.

The travel speed is a drive parameter which can preferably be preset by the machine operator himself and can also be changed by the machine operator during the operation of the construction machine. Therefore, in a preferred embodiment, the travel speed is a drive parameter which can be input using the control unit to control the drive means. However, it can also be provided that the machine operator presets work parameters, for example the milling depth.

The milling machine according to the invention can further provide that at least one function describing the dependence of an operating parameter of one assembly on at least one operating parameter of at least one other assembly is stored for each operating mode of the plurality of operating modes. A function of this type is understood as meaning all the information which describes a connection between one parameter and the other parameter. This function can also be, for example, a family of characteristics. Furthermore, in this preferred embodiment, the control and processing unit is configured such that, based on the function which describes the dependence of an operating parameter of one assembly on at least one operating parameter of at least one other assembly and which is stored in the memory for the operating mode selected using the selection unit, at least one assembly of the working means or drive means is controlled such that the particular machine function is carried out. Consequently, not only can a preset operating parameter of one assembly be considered during the control of the milling machine, but so can a connection between preset parameters of different assemblies.

If the operating parameters comprise drive parameters and work parameters, the control and processing unit can be configured such that, based on the function which describes the dependence of a work parameter of one assembly on at least one drive parameter of at least one other assembly, or based on the function which describes the dependence of a drive parameter of one assembly on at least one work parameter of at least one other assembly and which is stored in the memory for the operating mode selected using the selection unit, at least one assembly of the working means or drive means is controlled such that the particular machine function is carried out.

It is basically of no significance to the invention which machine functions are carried out by the individual assemblies. However, in the case of specific machine functions, the advantages of the invention are especially effective.

In an embodiment, an assembly of the drive means comprises motor-driven running gear units on which the construction machine stands, a drive parameter being the travel speed of the milling machine, and an assembly of the working means comprises a motor-driven milling/cutting drum, a work parameter being the speed of the milling/cutting drum. In this embodiment, a function describing the dependence of a work parameter of one assembly on a drive parameter of another assembly is a function describing the dependence of the speed of the milling/cutting drum on the travel speed of the milling machine. In this embodiment, the control and processing unit is configured such that, based on the function which describes the dependence of the speed of the milling/cutting drum on the travel speed of the milling machine and which is stored in the memory for the operating mode selected using the selection unit, the speed of the milling/cutting drum is set for a predetermined travel speed. Alternatively, the travel speed of the machine can be adapted by manually changing the speed of the milling/cutting drum.

For example, for the fine milling operating mode, a specific travel speed of the construction machine, which is a drive parameter, can be preset by the machine operator before the start of the milling work or it can also be changed during the milling work, the setting of the associated speed of the milling/cutting drum, which is a work parameter, then being carried out automatically subject to the travel speed. In this respect, different dependencies can be preset for different milling tasks, so that an optimum setting is carried out for the selected milling task. An embodiment can provide that the plurality of the operating modes which can be selected using the selection unit comprises at least one fine milling operating mode for a relatively fine milled surface with a shallower milling depth of the milling/cutting drum and a coarse milling operating mode for a relatively coarse milled surface with a greater milling depth of the milling/cutting drum, in which case, stored in the memory for the fine milling operating mode is a function which presets a higher speed of the milling/cutting drum for the fine milling operating mode than for the coarse milling operating mode at a predetermined travel speed. However, the machine operator can also be offered a selection of a plurality of milling operating modes which differ in the quality of the milled surface.

In another embodiment, an assembly of the working means is a device for feeding water into a milling/cutting drum housing which accommodates the milling/cutting drum and comprises a motor-driven pump device, a work parameter being the amount conveyed by the pump device. In this embodiment, for example for the fine milling operating mode, a work parameter can be stored in the memory, which work parameter presets a smaller amount conveyed by the pump device for the fine milling operating mode than for the coarse milling operating mode, at a predetermined travel speed.

In a further embodiment, an assembly of the working means is a motor-driven conveying device for conveying material removed by the milling/cutting drum, a work parameter being the amount conveyed by the conveying device. A work parameter can then be stored in the memory for the fine milling operating mode, which work parameter presets a smaller amount conveyed by the pump device for the fine milling operating mode than for the coarse milling operating mode, at a predetermined travel speed.

An assembly of the working means can also comprise a hold-down device which can be adjusted in height relative to the ground, which rests on the ground with a predetermined contact force and which is arranged upstream of the milling/cutting drum in the working direction of the milling machine, or a stripping device which can be adjusted in height relative to the ground, which rests on the ground with a predetermined contact force and which is arranged downstream of the milling/cutting drum in the working direction of the milling machine, or an edge protection device which can be adjusted in height relative to the ground, which rests on the ground with a predetermined contact force and is arranged in the longitudinal direction of the milling machine. In this embodiment, the work parameter is the height adjustment or contact force of the hold-down device or the height adjustment or contact force of the stripping device or the height adjustment or contact force of the edge protection device.

BRIEF DESCRIPTION OF THE DRAWINGS

In the following, an embodiment of the invention will be described in detail with reference to the drawings, in which.

DETAILED DESCRIPTION OF THE INVENTION

Figure 1:
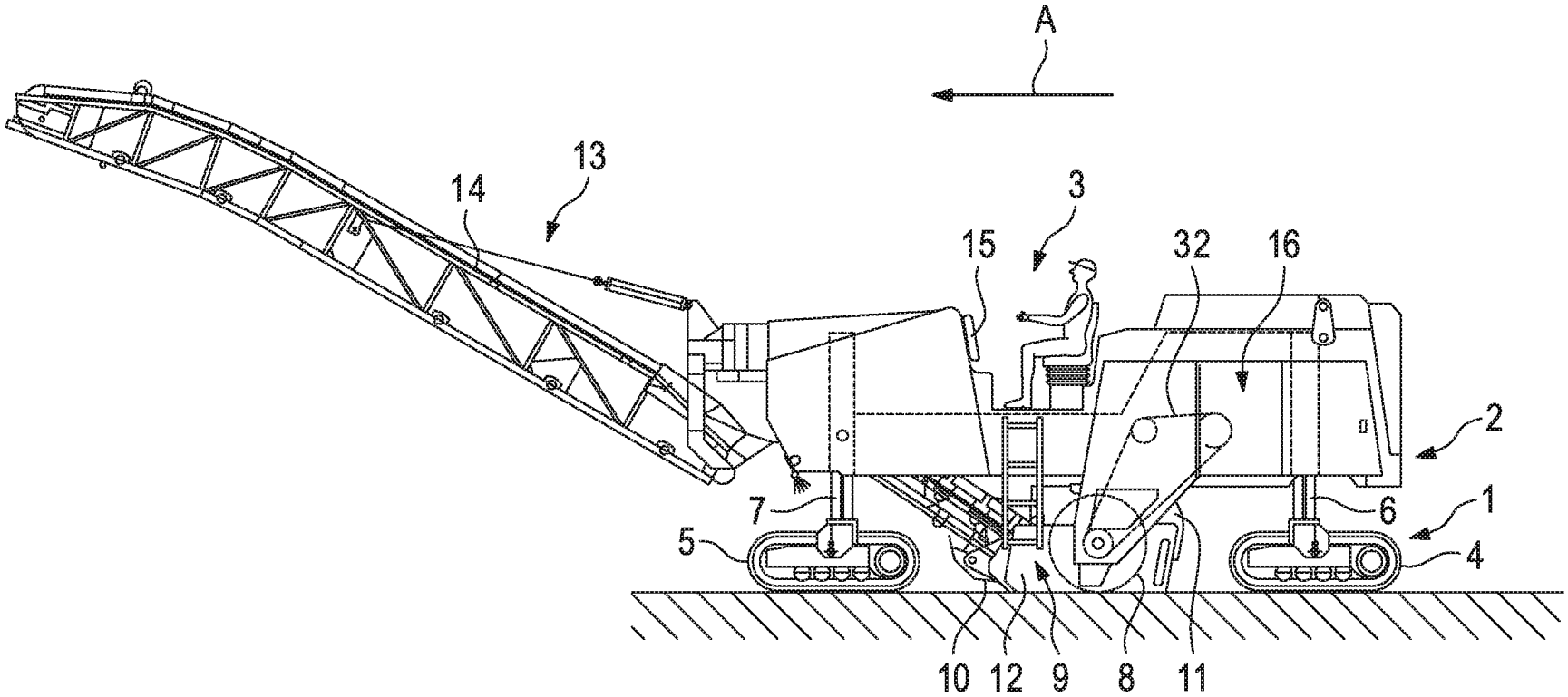
FIG. 1 is a schematic side view of an embodiment of a milling machine.

FIG. 1 is a simplified, schematic side view of a road milling machine as an example of a milling machine. However, the milling machine can also be a recycler, a stabiliser or a surface miner. These different embodiments of ground milling machines which belong to the prior art do not differ in the components which are essential to the invention.

The milling machine has a machine frame 2 which is supported by a chassis 1 and comprises an operator's platform 3. The chassis 1 of the milling machine can comprise four running gear units 4, 5 which are arranged at the back and at the front on both sides of the machine frame 2. The steerable running gear units 4, 5, in particular crawler tracks, which allow translatory and/or rotatory movements of the milling machine, are attached to lifting cylinders 6, 7 which are fitted to the machine frame 1, so that the machine frame can be adjusted in height. The running gear units 4, 5 can be crawler tracks. Instead of crawler tracks, it is also possible to provide wheels.

The milling machine has a driving engine 16, in particular an internal combustion engine, which is arranged on the machine frame. The driving power of the internal combustion engine is transmitted to hydraulic pumps by a pump distributor gearbox to supply hydraulic motors provided in the running gear units 4, 5 of the milling machine with hydraulic fluid. These components of the milling machine which belong to the prior art are not shown in FIG. 1.

The milling machine also has a milling/cutting drum 8 which is arranged in a milling drum housing 9. The milling drum 8 is driven by the single driving engine, the driving power of the driving engine 16 being transmitted to the milling/cutting drum 8 by a mechanical transmission 32. Furthermore, a device (not shown) for feeding water into the milling drum housing is provided which has a pump device (not shown).

The milling machine has further assemblies which cooperate in order to machine the ground using the milling/cutting drum. These assemblies which are merely indicated and also belong to the prior art are a hold-down device 10 which can be adjusted in height relative to the ground, which rests on the ground with a predetermined contact force and which is arranged upstream of the milling/cutting drum 8 in the working direction of the milling machine, a stripping device 11 which can be adjusted in height relative to the ground, which rests on the ground with a predetermined contact force and which is arranged downstream of the milling/cutting drum 8 in the working direction A of the milling machine, and an edge protection device 12 which can be adjusted in height relative to the ground on each longitudinal side of the milling/cutting drum 8, which rests on the ground with a predetermined contact force and extends in the longitudinal direction of the milling machine.

In turn, the individual assemblies can comprise a plurality of different components, for example actuators, sensors, etc. which are also not shown as they are generally known to a person skilled in the art.

A conveying device 13 having a conveyor belt 14 is provided to remove the material stripped off by the milling/cutting drum.

To control the milling machine, the machine operator can input different operating parameters by means of a control unit 15 which can be provided on the operator's platform 3. In the present embodiment, the relevant components of the individual assemblies are controlled by means of a central control and processing unit. However, a plurality of individual control and processing units can also be provided.

The control and processing unit can have, for example, a general processor, a digital signal processor (DSP) for continuously processing digital signals, a microprocessor, an application-specific integrated circuit (ASIC), an integrated circuit consisting of logic elements (FPGA) or other integrated circuits (IC) or hardware components to carry out the individual steps of the method. A data processing program (software) can run on the hardware component to carry out the steps of the method. A plurality or a combination of the different components is also possible.

Figure 2:
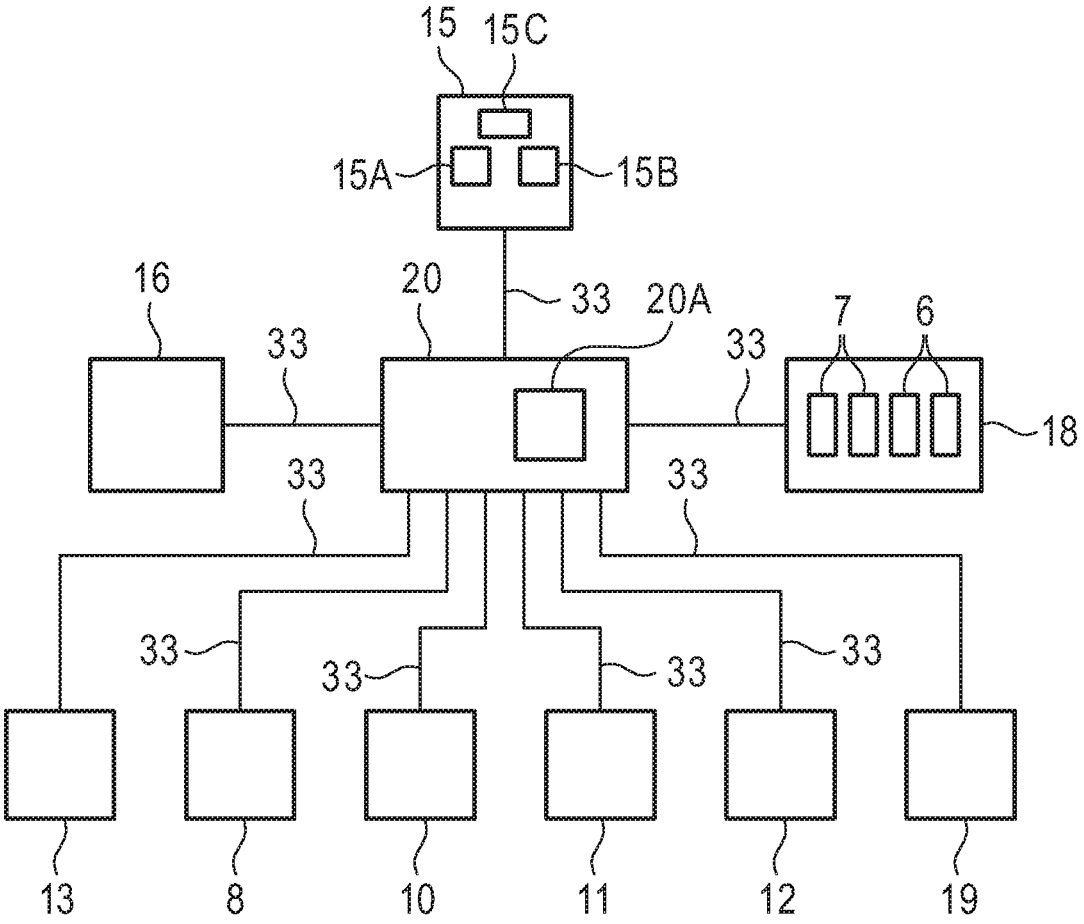
FIG. 2 is a block diagram with the essential components of the milling machine.

FIG. 2 shows a simplified block diagram with the essential components of the milling machine. The drive means comprises the driving engine 16 and also the running gear units (not shown) which each have a hydraulic motor. The work means comprises, in addition to the driving engine 16, as a common component with the drive means, the milling/cutting drum 8, the hold-down device 10 arranged upstream of the milling/cutting drum in the working direction, the stripping device 11 downstream of the milling/cutting drum and the edge protection device 12 on both sides of the milling/cutting drum. A further assembly of the working means is the device 18 for adjusting the height of the machine frame 1 which has the four lifting columns 6, 7 so that the milling depth can be adjusted. Furthermore, the working means has the device 19 for supplying water by means of the pump device, as well as the conveying device 13 comprising the conveyor belt 14. The individual assemblies are connected to the central control and processing unit 20 by control lines 33.

The speed of the driving engine 16 determines the speed n of the milling/cutting drum 8 which is driven by the driving engine via the mechanical transmission 32, while the travel speed v is adjusted by a corresponding adjustment of the hydraulic pumps for the hydraulic motors.

The control unit 15 has an input unit 15A which can have, for example, pushbuttons, switches, sliders, a keyboard or a touch screen in order to be able to input specific parameters manually. The control unit 15A can also have a joystick to control the machine, in particular the steerable running gear units. The control unit has a display unit 15B, for example a screen, to monitor the machine functions.

The control unit 15 also has a selection unit 15C which, however, can also be part of the input unit, for example it can be configured as a touch screen together with the input unit. The selection unit 15C allows the machine operator to select an operating mode Mx from a plurality of operating modes M1 to Mn. The selection unit can have pushbuttons, switches or buttons on a touch screen which are associated with the individual operating modes M1 to Mn. A further possible embodiment is a rotary switch with rotational positions associated with the modes of operation.

In the present invention, a selection can be made between the operating modes of micro-milling I, micro milling II, fine milling I, fine milling II, standard milling I, standard milling II, standard milling III and coarse milling (rough milling), it being possible to select different milling tasks for individual types of milling. The individual milling tasks are identified by the index "I", "II" or "III". The milling tasks can be different milled surfaces which can differ in the roughness of the surface. Different general conditions can also be considered, for example the type of ground (concrete or asphalt), or whether a machining of the ground is to be carried out which is as fast as possible or low-wear.

Allocated to each operating mode is a data record which is stored in a memory 20A of the control and processing unit 20. Each data record contains the drive and work parameters which are considered optimum for the particular task. In this respect, the data record does not have to contain all the parameters which have to be set in order to complete the task. It is also possible for the data record not to contain individual operating parameters, in particular the parameters which are to be changed by the machine operator during the operation of the milling machine. These parameters can be input manually by the machine operator using the control unit.

Figure 3:
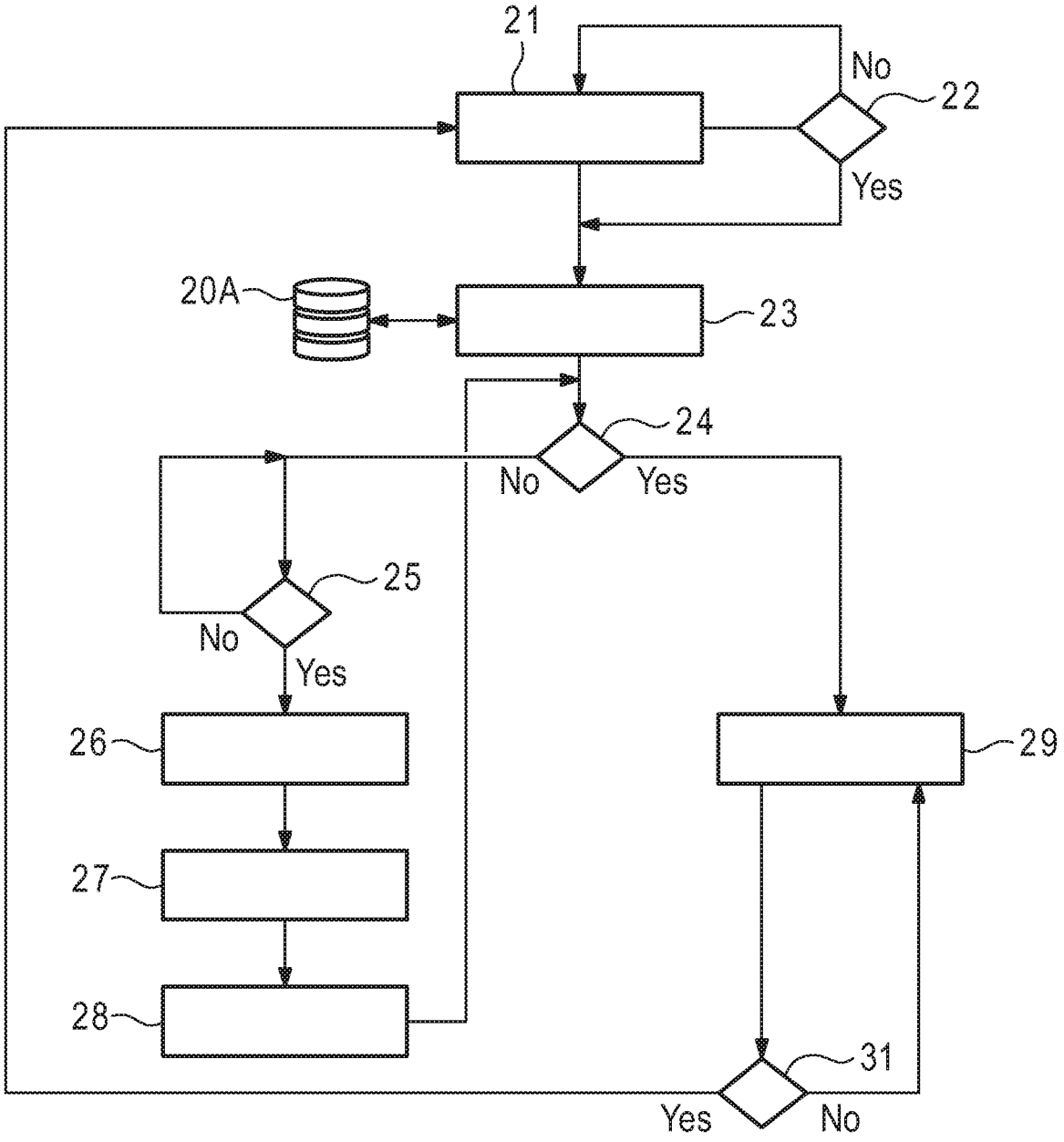
FIG. 3 is a flow chart showing the individual steps of the method.

In the following, the operation of the milling machine is described in detail using the flow chart of FIG. 3.

Before the start of the milling work, the machine operator uses the selection unit 15C, for example by turning a rotary switch on the control unit 15, to select an operating mode M1 to Mn, for example the "fine milling I" operating mode (block 21: "selection of an operating mode"). The present embodiment provides an additional checking routine. The milling/cutting drum which is used is characterised by an identification, for example a barcode, which is read out by a reading device (not shown). The data record which is assigned to the "fine milling I" operating mode contains a list of identifications of different milling/cutting drums which can carry out the milling task, for example types of milling drum for fine milling. The control and processing unit 20 checks whether the identification of the milling/cutting drum which is used has been entered on the list (block 22: "compatibility with drum?"). If this is the case, it is concluded that the milling machine has been fitted with the correct type of milling drum for "fine milling I". Thereafter, the drive and work parameters which have been assigned to the "fine milling I" operating mode are read out of the memory 20A (block 23: "read out operating parameters"). At this time, the machine is not being operated, i.e. the machine is stationary and the milling/cutting drum has not been lowered (block 24: "machine in operation?").

Since the milling machine has not yet been put into operation by the machine operator, in the next step the question is asked whether the milling operation should be started (block 25: "start milling operation?"). If this is the case, from the "fine milling I" data record, the further control is based on the drive and work parameters required for the start of the milling operation (block 26: "setting the operating parameters for the start of the machine"). In the present embodiment, preset for the so-called positioning of the milling machine as one of the operating parameters is a speed nA for the driving engine which is, for example, 1600 rpm, so that sufficient power is available for the positioning procedure. The milling depth is not preset as a work parameter for the positioning procedure, because the milling/cutting drum 8 is lowered manually to the required depth by the machine operator by actuating the lifting columns 5, 6 (block 27: "lower to milling depth"). After the milling/cutting drum 8 has been lowered, i.e. after the milling depth has been set, the machine operator starts the running gear units 4, 5 (block 28: "start-up"). The milling machine is thereby set into operation (block 24: "milling machine in operation?").

During the milling operation, the individual assemblies of the milling machine are controlled by the control and processing unit 20 such that the assemblies carry out the respective machine functions based on the drive and work parameters of the "fine milling I" operating mode (block 29: "setting the operating parameters for milling operation"). In the following, the method steps which are carried out while bearing in mind the selected mode of operation are described in detail with reference to block 29.

For milling operation, the control and processing unit 20 sets as an operating parameter the motor speed n, for example, which can be a different speed than for the positioning of the milling/cutting drum. This motor speed n can also be contained in the "fine milling I" data record as a fixed variable. The "fine milling II" data record can differ from the "fine milling I" data record in that the work parameter of the motor speed n for "fine milling II" is greater than or less than the work parameter of the motor speed n for "fine milling I". With the motor speed as an example of a work parameter, inter alia the milling drum speed which determines the quality of the milled surface is influenced. If "fine milling II" is to be an operating mode with a finer milled surface, i.e. a surface with a lower degree of roughness, the required milling drum speed and thereby the required motor speed n for "fine milling II" is greater than for "fine milling I".

However, the milled surface is also determined by the travel speed v of the milling machine which can be changed by the machine operator during the operation of the machine. A higher travel speed v requires a higher milling drum speed and thus a higher motor speed n. Therefore, travel speed v and motor speed n are connected.

In a preferred embodiment, for the motor speed n, a fixed value is therefore not preset, but rather a value which depends on the travel speed v. The connection between motor speed n and travel speed v can be described by a function, for example by the function $k=v/n$, where k is a constant. Different functions which can differ from one another, for example, in the constant k, are stored in the memory 20A of the control and processing unit 20 for the different operating modes.

Alternatively, the connection between travel speed v and motor speed n can also be a non-linear connection. The motor speed is more preferably controlled in discrete steps. For example, motor speeds of 1200 min−1, 1600 min−1, 1800 min−1 and 2100 min−1 can be provided for the milling operation. In this case, it is more preferably provided to keep the ratio v/n between travel and motor speed within a particular range. For this, the motor speed can be adapted when limiting values are exceeded or are not met for the travel speed. For the different operating modes, it is therefore possible to store in the memory 20A of the control and processing unit 20 different functions which differ, for example, in the predetermined ranges within which the relationship between travel and motor speed are located.

For the travel speed v which is previously set by the machine operator in the input unit 15A, the computation and evaluation unit calculates with the function stored for "fine milling I" the necessary motor speed n which can be a different speed for "fine milling I" than, for example, for the "fine milling II" or "coarse milling" operating mode. During the operation of the milling machine, the control and processing unit 20 continuously monitors the travel speed which has been preset by the machine operator. If the machine operator has changed the travel speed, the control and processing unit 20 calculates the new motor speed with the function stored for the selected mode of operation, and then adjusts the new motor speed (in block 29: "setting the operating parameters for milling operation").

As an alternative, the travel speed v can be calculated and adjusted using the function even after presetting a motor speed n. Consequently, a drive parameter can determine a work parameter or vice versa during the control of the individual assemblies.

Furthermore, for the milling operation, the work parameters for controlling the other assemblies of the working means are also read out in order to control actuators or other drive devices of these assemblies. Included among these parameters are in particular the height h of the hold-down device 10, of the stripping device 11 and of the edge protection device 12 and the contact force thereof on the ground. The height of the hold-down device 10, of the stripping device 11 and of the edge protection device 12 depends in particular on the height of the machine frame 1 relative to the surface of the ground which, in turn, determines the milling depth. During the milling operation, the control and processing unit 20 sets the hold-down device 10, the stripping device 11 and the edge protection device 12 at the height or at the contact force thereof which has been predetermined by the parameters.

The control and processing unit 20 also controls the pump device of the device 19 for feeding water into the milling drum housing 9 such that the amount of water, preset by the corresponding work parameter for the "fine milling I" operating mode, is supplied. This amount of water can be less than the amount of water which is preset by the corresponding work parameters for standard milling I, II, III which, in turn, can be less than the amount of water for coarse milling.

The control and processing unit 20 can also control the conveying device 13, present in milling machines, on the basis of a further work parameter, since for example the "fine milling" operating mode requires the adjustment of a smaller conveyed amount than "coarse milling".

The above-mentioned operating parameters can not only be fixed variables, but they can also be variables which depend on other operating parameters, as is the case, for example, for the speed of the milling/cutting drum. Therefore, the above-described assemblies can also be controlled on the basis of the function which describes the dependence of an operating parameter of one assembly on at least one operating parameter of at least one other assembly and which is stored in the memory for the operating mode selected using the selection unit. In this respect, for the start of the milling operation, a predetermined value can be initially set subject to the operating mode, and can then be changed during the milling operation subject to at least one operating parameter.

The above-mentioned operating parameters can also depend on a plurality of other operating parameters. For example, the motor speed n can be controlled not only depending on the travel speed v but also depending on the power requirement of the consumers driven by the drive unit. Consequently, different presettings can be made for the different operating modes.

In one operating mode, for example the motor speed can be a function which is dependent on the travel and for which a specific minimum motor speed is functionally assigned to a specific travel speed, for example 1600 min−1 at a travel rate of 15 m/min. However, if the motor speed, determined dependent on the travel speed, is insufficient for covering the power requirement of the consumers, the motor speed is increased independently of the travel. If the travel is then increased, this can then lead to a further increase in the motor speed, depending on the functional connection mentioned above, if the minimum motor speed, determined depending on the travel, is above the currently set motor speed.

The amount conveyed by the pump device of the device 19 for feeding water into the milling drum housing 9 can be set, for example, on the basis of a predetermined function which is stored in the memory 20C, and is read out of the memory for the selected operating mode, depending on at least one operating parameter of an assembly or of a plurality of assemblies. The function can describe the dependence of the conveyed amount on the travel speed (drive parameter) and on the milling depth (work parameter), in which case the conveyed amount should increase as the travel speed increases and it should also increase as the milling depth increases.

During the operation of the milling machine, the previously predetermined and set operating parameters are continuously monitored, the control and processing unit 20 continuously checking whether the operating parameters which were previously read out of the memory 20A and on the basis of which the control is currently being carried out have been changed (block 31: "change of operating parameters?"). If the parameters have been changed, the new sets of parameters are queried. If this is not the case, the control of the machine is continued based on the previous parameters.

The invention claimed is:

1. A milling machine, comprising:

a drive unit configured for carrying out one or more of translatory and rotatory movements of the milling machine on the ground;

a working unit configured for machining of the ground;

at least two assemblies which carry out specific machine functions subject to operating parameters;

a selection unit configured to enable manual selection by a machine operator of an operating mode from a plurality of operating modes;

wherein the plurality of operating modes comprise at least a first operating mode having one or more set values or functions assigned thereto for optimizing a quality of a machined ground surface, at least a second operating mode having one or more set values or functions assigned thereto for optimizing a required working time of the milling machine, and at least a third operating mode having one or more set values or functions assigned thereto for optimizing wear on tools of the working unit; and a control and processing unit configured to control at least one of the at least two assemblies of the milling machine such that a specific machine function is carried out, based at least in part on one or more operating parameters which are automatically adjusted based on the selected operating mode.

2. The milling machine of claim 1, wherein the control and processing unit is further configured to determine whether a component of the working unit is compatible with a type of component specified for the selected operating mode.

3. The milling machine of claim 2, wherein the component of the working unit is a milling drum having a machine-readable identification.

4. The milling machine of claim 1, wherein:

the control and processing unit comprises a memory in which is stored, for each operating mode of the plurality of operating modes, one or more of:

respective set values for at least two predetermined operating parameters which are assigned to the respective operating mode, and at least one function describing the dependence of an operating parameter of one assembly on at least one other operating parameter; and the control and processing unit is configured to control at least one of the at least two assemblies of the milling machine such that a specific machine function is carried out, based on one or more of:

the respective set values for the at least two operating parameters which are stored in the memory for the selected operating mode, and the at least one function which is stored in the memory for the selected operating mode.

5. The milling machine of claim 4, wherein the at least one function comprises at least one function describing the dependence of an operating parameter of one assembly on at least one operating parameter of at least one other assembly.

6. The milling machine of claim 4, wherein the at least one function comprises at least one function describing the dependence of an operating parameter of one assembly on at least one operating parameter of the same assembly.

7. The milling machine of claim 1, wherein the operating parameters comprise drive parameters and work parameters, the drive unit comprising at least one assembly of the at least two assemblies which performs a specific machine function subject to drive parameters, and the working unit comprising at least one assembly of the at least two assemblies which performs a specific machine function subject to work parameters.

8. The milling machine of claim 7, wherein:

an assembly of the drive unit comprises motor-driven running gear units on which the milling machine stands, wherein a drive parameter is the travel speed of the milling machine, and an assembly of the working unit comprises a motor-driven milling/cutting drum, wherein a work parameter is the speed of the milling/cutting drum.

9. The milling machine of claim 8, wherein the control unit is configured to enable input of the travel speed as a drive parameter to control the drive unit.

10. The milling machine of claim 7, wherein the memory has stored therein, for each operating mode of the plurality of the operating modes which can be selected using the control unit, one or more of:

at least two predetermined work parameters which are assigned to the operating mode; and at least one function which describes the dependence of a work parameter of one assembly on at least one drive parameter of at least one other assembly; and at least one function which describes the dependence of a drive parameter of one assembly on at least one work parameter of at least one other assembly; and the control and processing unit is configured such that one or more of:

at least one assembly associated with the drive unit or the working unit is controlled subject to the at least two work parameters which are stored in the memory for the selected operating mode, such that the specific machine function is carried out;

at least one assembly associated with the drive unit or the working unit is controlled, based on the at least one function which is stored in the memory for the selected operating mode and describes the dependence of a work parameter of one assembly on at least one drive parameter of at least one other assembly, such that the specific machine function is carried out; and at least one assembly associated with the drive unit or the working unit is controlled, based on the at least one function which is stored in the memory for the selected operating mode and describes the dependence of a drive parameter of one assembly on at least one work parameter of at least one other assembly, such that the particular machine function is carried out.

11. The milling machine of claim 7, wherein an assembly of the working unit comprises:

a hold-down device which is adjustable in height relative to the ground, which rests on the ground with a predetermined contact force and which is arranged upstream of the milling/cutting drum in a working direction of the milling machine;

a stripping device which is adjustable in height relative to the ground, which rests on the ground with a predetermined contact force and which is arranged downstream of the milling/cutting drum in the working direction of the milling machine; or an edge protection device which is adjustable in height relative to the ground, which rests on the ground with a predetermined contact force and is arranged in the longitudinal direction of the milling machine, wherein a work parameter is the height adjustment or the contact force of the hold-down device or stripping device or edge protection device.

12. A method for operating a milling machine, having a drive unit for carrying out translatory and/or rotatory movements, and a working unit for machining of the ground, wherein the milling machine has at least two assemblies which carry out specific machine functions subject to operating parameters, the method comprising:

receiving, via a manually operable selection unit, a selection by a machine operator of an operating mode from a plurality of operating modes, wherein the plurality of operating modes comprise at least a first operating mode having one or more set values or functions assigned thereto for optimizing a quality of a machined ground surface, at least a second operating mode having one or more set values or functions assigned thereto for optimizing a required working time of the milling machine, and at least a third operating mode having one or more set values or functions assigned thereto for optimizing wear on tools of the working unit; and controlling at least one of the at least two assemblies of the milling machine such that a specific machine function is carried out, based at least in part on one or more operating parameters which are automatically adjusted based on the selected operating mode.

13. The method of claim 12, further comprising determining whether a component of the working unit is compatible with a type of component specified for the selected operating mode.

14. The method of claim 13, wherein the step of determining whether a component of the working unit is compatible with a type of component specified for the selected operating mode comprises reading a machine-readable identification from a milling drum as the component of the working unit.

15. The method of claim 12, further comprising:

storing in a memory, for each operating mode of the plurality of operating modes, one or more of:

respective set values for at least two predetermined operating parameters which are assigned to the respective operating mode, and at least one function describing the dependence of an operating parameter of one assembly on at least one other operating parameter; and controlling at least one of the at least two assemblies of the milling machine such that a specific machine function is carried out, based on one or more of:

the respective set values for the at least two operating parameters which are stored in the memory for the selected operating mode, and the at least one function which is stored in the memory for the selected operating mode.

16. The method of claim 15, wherein the at least one function comprises at least one function describing the dependence of an operating parameter of one assembly on at least one operating parameter of at least one other assembly.

17. The method of claim 16, wherein the at least one function comprises at least one function describing the dependence of an operating parameter of one assembly on at least one operating parameter of the same assembly.

18. The method of claim 12, wherein:

the operating parameters comprise drive parameters and work parameters, the drive unit comprises at least one assembly of the at least two assemblies which performs a specific machine function subject to drive parameters, and the working unit comprises at least one assembly of the at least two assemblies which performs a specific machine function subject to work parameters.

19. The method of claim 18, further comprising:

storing in a memory, for each operating mode of the plurality of the selectable operating modes, one or more of:

at least two predetermined work parameters which are assigned to the operating mode;

at least one function which describes the dependence of a work parameter of one assembly on at least one drive parameter of at least one other assembly; and at least one function which describes the dependence of a drive parameter of one assembly on at least one work parameter of at least one other assembly; and controlling one or more of:

at least one assembly associated with the drive unit or the working unit subject to the at least two work parameters which are stored in the memory for the selected operating mode, such that the specific machine function is carried out;

at least one assembly associated with the drive unit or the working unit, based on the at least one function which is stored in the memory for the selected operating mode and describes the dependence of a work parameter of one assembly on at least one drive parameter of at least one other assembly, such that the specific machine function is carried out; and at least one assembly associated with the drive unit or the working unit, based on the at least one function which is stored in the memory for the selected operating mode and describes the dependence of a drive parameter of one assembly on at least one work parameter of at least one other assembly, such that the particular machine function is carried out.

20. The method of claim 12, wherein:

a travel speed is input into an input unit to control the drive unit; and wherein a function that is assigned to one operating mode of the plurality of selectable operating modes automatically adjusts at least one operating parameter to a higher value than for another operating mode of the plurality of selectable operating modes at a predetermined travel speed.

* * * * *